US012123126B2

(12) United States Patent
Giacomini et al.

(10) Patent No.: US 12,123,126 B2
(45) Date of Patent: Oct. 22, 2024

(54) SYSTEM FOR LAUNDRY DETERGENT DELIVERY

(71) Applicant: WHIRLPOOL CORPORATION, Benton Harbor, MI (US)

(72) Inventors: Neomar Giacomini, St. Joseph, MI (US); YuKai Bao, West Lafayette, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 822 days.

(21) Appl. No.: 17/082,598

(22) Filed: Oct. 28, 2020

(65) Prior Publication Data

US 2021/0164149 A1 Jun. 3, 2021

Related U.S. Application Data

(60) Provisional application No. 62/942,839, filed on Dec. 3, 2019.

(51) Int. Cl.

| | |
|---|---|
| ***D06F 39/02*** | (2006.01) |
| ***D06F 33/37*** | (2020.01) |
| ***D06F 33/47*** | (2020.01) |
| ***D06F 34/05*** | (2020.01) |
| ***D06F 34/10*** | (2020.01) |
| *D06F 103/42* | (2020.01) |
| *D06F 105/42* | (2020.01) |

(52) U.S. Cl.

CPC ..... *D06F 39/022* (2013.01); *D06F 33/37* (2020.02); *D06F 33/47* (2020.02); *D06F 34/05* (2020.02); *D06F 34/10* (2020.02); *D06F 39/028* (2013.01); *D06F 2103/42* (2020.02); *D06F 2105/42* (2020.02)

(58) Field of Classification Search

CPC ..... D06F 39/022; D06F 33/47; D06F 34/05; D06F 34/10; D06F 33/37; D06F 39/028; D06F 2105/42; D06F 2103/42; D06F 33/57

See application file for complete search history.

(56) References Cited

U.S. PATENT DOCUMENTS

| | | | |
|---|---|---|---|
| 7,950,088 | B2 | 5/2011 | Dalton et al. |
| 8,122,743 | B2 | 2/2012 | Schulze |
| 8,171,757 | B2 | 5/2012 | Dahlke |
| 8,485,000 | B2 | 7/2013 | Lim et al. |

(Continued)

FOREIGN PATENT DOCUMENTS

| | | |
|---|---|---|
| EP | 2447640 | 5/2012 |
| WO | 0220893 | 3/2002 |
| WO | 2015022622 | 2/2015 |

*Primary Examiner* — Vishal Pancholi
*Assistant Examiner* — Robert K Nichols, II
(74) *Attorney, Agent, or Firm* — Price Heneveld LLP

(57) ABSTRACT

A laundry appliance includes a compartment defined within a cabinet. A cartridge is selectively received within the compartment. The cartridge includes a self-actuating pump for dispensing a consumable from an interior of the cartridge. A mixing chamber is positioned under the self-actuating pump. The mixing chamber receives a dispensed portion of the consumable. A fluid dispenser dispenses a base fluid into the mixing chamber. The fluid dispenser is upstream of the self-actuating pump and the base fluid carries the dispensed portion to a processing chamber contained within the cabinet.

20 Claims, 6 Drawing Sheets

(56) References Cited

U.S. PATENT DOCUMENTS

| | | | | |
|---|---|---|---|---|
| 8,943,858 | B2 | 2/2015 | Burgess | |
| 8,980,014 | B2 | 3/2015 | Classen et al. | |
| 9,217,219 | B2 | 12/2015 | Hanau et al. | |
| 9,534,831 | B2 * | 1/2017 | Cur | B67D 1/0001 |
| 9,624,618 | B2 | 4/2017 | Del Pos et al. | |
| 10,233,585 | B2 | 3/2019 | Fu et al. | |
| 10,397,760 | B2 | 8/2019 | Park et al. | |
| 10,676,855 | B2 * | 6/2020 | Clayton | D06F 34/32 |
| 2006/0081016 | A1 * | 4/2006 | Hsu | D06F 39/022 68/17 R |
| 2009/0100881 | A1 * | 4/2009 | Dahlke | D06F 39/022 222/394 |
| 2010/0071777 | A1 | 3/2010 | Smith et al. | |
| 2013/0175292 | A1 | 7/2013 | Burgess | |
| 2019/0092616 | A1 | 3/2019 | Hikem et al. | |
| 2019/0345660 | A1 * | 11/2019 | Nam | D06F 39/022 |

* cited by examiner

METHOD 400 FOR PROVIDING A PURCHASE REQUEST AND/OR REORDER ALERT FOR CONSUMABLE

SYSTEM FOR LAUNDRY DETERGENT DELIVERY

CROSS-REFERENCE TO RELATED APPLICATION

This application claims priority to and the benefit under 35 U.S.C. § 119(e) of U.S. Provisional Patent Application No. 62/942,839, filed on Dec. 3, 2019, entitled SYSTEM FOR LAUNDRY DETERGENT DELIVERY, the entire disclosure of which is hereby incorporated herein by reference.

FIELD OF THE DEVICE

The device is in the field of laundry appliances, and more specifically, a washing machine having a detergent dispensing system.

SUMMARY

According to one aspect of the present disclosure, a laundry appliance includes a compartment defined within a cabinet. A cartridge is selectively received within the compartment. The cartridge includes a self-actuating pump for dispensing a consumable from an interior of the cartridge. A mixing chamber is positioned under the self-actuating pump. The mixing chamber receives a dispensed portion of the consumable. A fluid dispenser dispenses a base fluid into the mixing chamber. The fluid dispenser is upstream of the self-actuating pump and the base fluid carries the dispensed portion to a processing chamber contained within the cabinet.

According to another aspect of the present disclosure, a dispensing assembly for a laundry appliance includes a cartridge having a cartridge connector and that is selectively received within a compartment having a machine connector. A self-actuating pump is contained within the cartridge. The self-actuating pump operates to dispense a consumable from an interior of the cartridge. A mixing chamber is positioned under the self-actuating pump. The mixing chamber receives a dispensed portion of the consumable. A fluid dispenser dispenses a base fluid into the mixing chamber. The fluid dispenser is upstream of the self-actuating pump. A cartridge interface is defined between the cartridge connector and the machine connector. The cartridge interface delivers an actuating electrical current to the self-actuating pump.

According to yet another aspect of the present disclosure, a dispensing assembly for a laundry appliance includes a plurality of cartridges that are selectively received within a compartment having corresponding machine connectors. Each cartridge of the plurality of cartridges includes a self-actuating pump, cartridge circuitry and a cartridge connector in communication with the self-actuating pump and the cartridge circuitry. Each cartridge of the plurality of cartridges contains a respective consumable. A mixing chamber is positioned under the plurality of cartridges. The mixing chamber receives a dispensed portion of each respective consumable from the plurality of cartridges. A fluid dispenser dispenses a base fluid into the mixing chamber. The fluid dispenser is upstream of the self-actuating pumps of the plurality of cartridges. A cartridge interface is defined between each cartridge connector of the plurality of cartridges and corresponding machine connectors of the compartment. The cartridge interface delivers an actuating electrical current to each of the self-actuating pumps.

These and other features, advantages, and objects of the present disclosure will be further understood and appreciated by those skilled in the art by reference to the following specification, claims, and appended drawings.

DETAILED DESCRIPTION OF EMBODIMENTS

Figure 1:
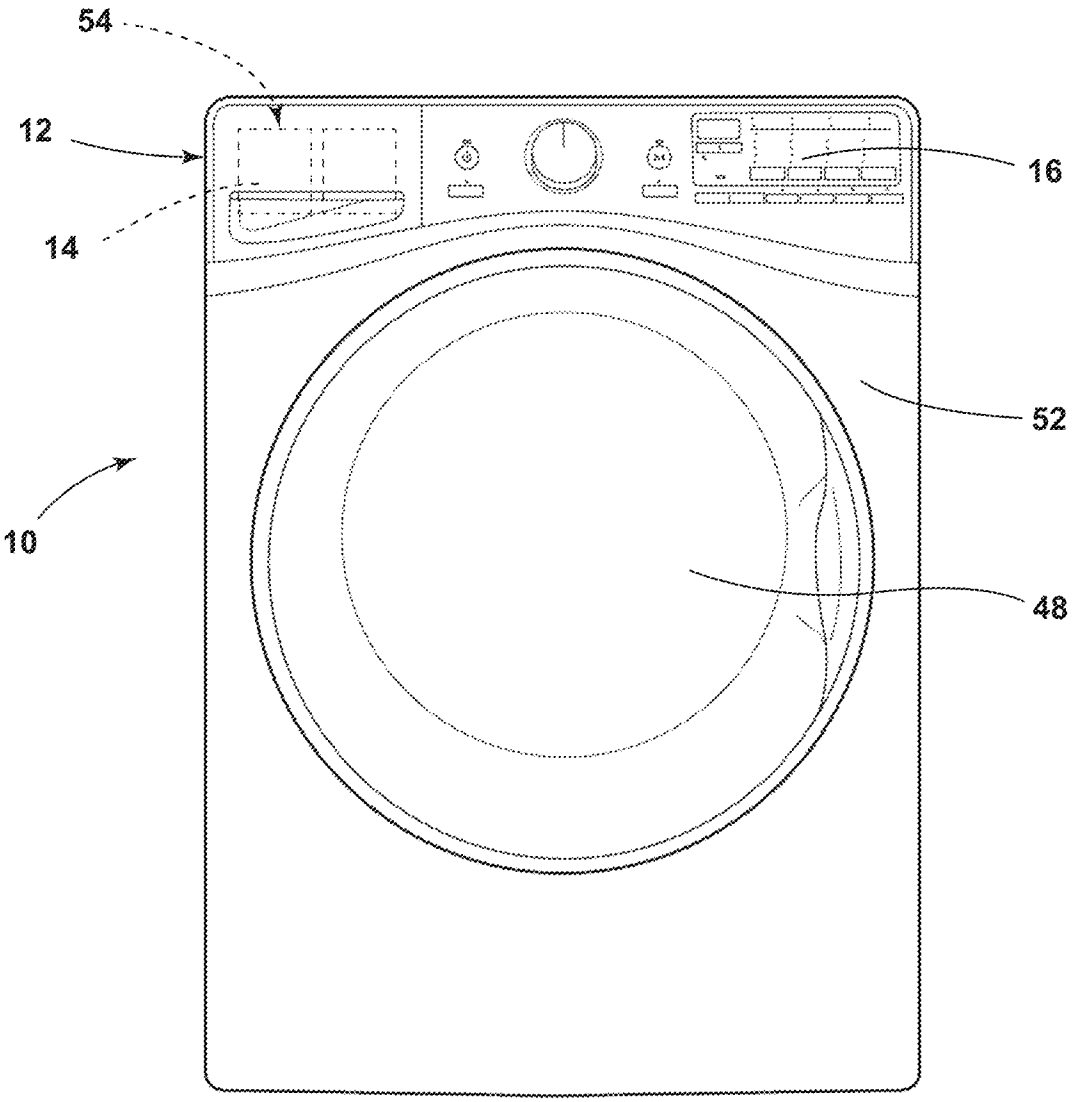
FIG. 1 is a front elevational view of a laundry appliance incorporating an aspect of the detergent delivery system.

The present illustrated embodiments reside primarily in combinations of method steps and apparatus components related to a laundry consumable delivery system that includes a self-actuating pump positioned within a cartridge containing the consumable. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
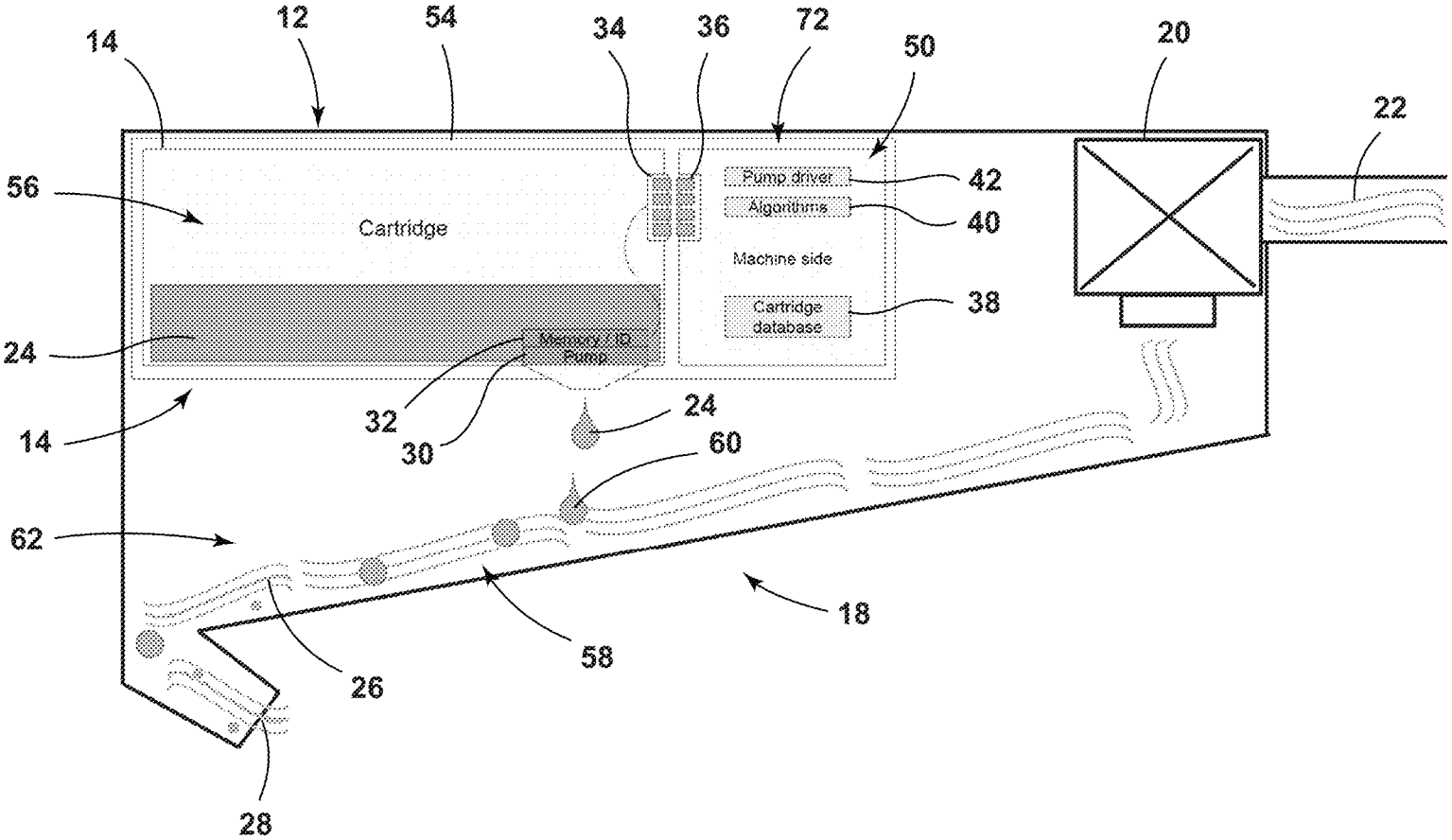
FIG. 2 is a cross-sectional view illustrating an aspect of a mixing chamber of the laundry appliance.

As illustrated in FIGS. 1 and 2, reference numeral 10 generally refers to a laundry appliance such as a washer, dryer, combination washer/dryer and other similar laundry-treating devices. The laundry appliance 10 includes a compartment 12 positioned within a cabinet 52 and configured to receive at least one cartridge 14 and typically a plurality of cartridges 14. Each cartridge 14 contains bulk amounts of a corresponding consumable 24. The compartment 12 includes a corresponding plurality of slots 54 for receiving the various cartridges 14. The compartment 12 is positioned proximate the processing chamber 48, such as a tub or a rotating drum, for receiving one or more articles to be washed. In various aspects, the consumable 24 is dispensed from an interior 56 of the cartridge 14 and into a base fluid 22, such as water, to form a laundry solution 26. In some embodiments, the consumable 24 is a premixed solution. The consumable can be any one or more of various laundry chemistries that can include, but are not limited to, detergent, bleach, fabric softener, specialty detergent, combinations thereof and other similar products relates to the cleaning, conditioning or processing of the one or more articles.

Referring again to FIGS. 1-2, the laundry appliance 10 typically includes one or more user interface controls 16 for selecting a wash cycle. The laundry appliance 10 further includes a mixing chamber 18. Based on the selected laundry cycle, a dispensing assembly of the laundry appliance 10 dispenses the base fluid 22 into the mixing chamber 18 through a fluid dispenser 20. In certain aspects, the fluid dispenser 20 is configured to dispense the base fluid 22 at a variable and/or predetermined flow rate. As the base fluid 22 is dispensed, the laundry appliance 10, typically via machine circuitry 50 or other similar controller 72, concurrently delivers a command to at least one of the cartridges 14 to actuate a pump 30 to dispense a desired amount of consumable 24, or amounts of various consumables 24, into the mixing chamber 18 to define a dispensed portion 58 of the consumable 24 or consumables 24.

In some aspects, the dispensed portion 58 of the consumable 24 is dispensed at a desired and/or known flow rate so that the consumable 24 can be dispensed in dosed amounts 60 over an extended period of time, such several seconds, a minute or over several minutes, thereby providing the dispensed portion 58 of the consumable 24 into the mixing chamber 18. This extended dosing 62 of the consumable 24 over a predetermined period of time allows for proper mixing of the consumable 24 with the base fluid 22. Extended dosing 62 also ensures that the consumable 24 is well mixed or otherwise dispensed throughout the laundry at the beginning of the laundry cycle. By way of example and not limitation, the self-actuating pump 30 may include a dosing rate of approximately 6 mL per minute ("mL/min"). If a particular laundry cycle requires 30 milliliters ("mL") of consumable 24, it is expected that the extended period of time for completing the extended dosing 62 will be approximately five minutes, during which the self-actuating pump 30 is activated. It is also contemplated that the extended dosing 62 can occur during a fill stage of a laundry cycle. In this fill stage, the base fluid 22 is dispensed into the processing chamber 48 of the appliance 10. The extended dosing 62 may occur over at least a portion of the fill stage or over the entire course of the fill stage. In these aspects of the device, the extended dosing 62 dispenses small dosed amounts 60 of the consumable 24 into the mixing chamber 18 and the base fluid 22 combines with and carries the consumable to the processing chamber 48. Typically, the fluid dispenser 20 will be the sole source of base fluid 22 for disposing the base fluid 22 within the processing chamber 48.

During the extended dosing 62 of the consumable 24, the desired amount of consumable 24 is dispensed into the mixing chamber 18. Typically, the base fluid 22 will be dispensed within the mixing chamber 18 during the extended dosing 62 of the consumable 24. The fluid dispenser 20 is positioned upstream of the cartridge 14 or cartridges 14 so that the base fluid 22 can flow beneath the cartridges 14. Using this configuration, the base fluid 22 and the consumable 24 are thereby combined within the mixing chamber 18 to form a laundry solution 26. The laundry solution 26 represents a pre-mixed combination of one or more of the consumables 24 and the base fluid 22. Typically, the flow rates of the base fluid 22 and the one or more consumables 24 will be relatively consistent during the extended dosing 62. Accordingly, the proportional relationship of consumable 24 to base fluid 22 that makes up the laundry solution 26 will typically be consistent. The laundry solution 26 is directed from the mixing chamber 18 through outlet 28 into a processing chamber 48 for washing the one or more articles.

The various cartridges 14 are positioned within the compartment 12 and specifically within respective slots 54 defined within the compartment 12. These slots 54 position the cartridges 14 proximate the mixing chamber 18 and are typically configured to dispense the consumable 24 directly into the mixing chamber 18. It should be understood that any practical manner of fluidly coupling the cartridge 14 to the mixing chamber 18 is contemplated. The slots 54 can be configured to receive a specific type of cartridge 14 such that each slot 54 has a different shape. The slots 54 may also be similarly configured so that the various cartridges 14 can be disposed within any of the slots 54 for the compartment 12.

In some embodiments, the consumable 24 is a dry consumable (e.g., powdered detergent) and the cartridge 14 includes a suitable device for dispensing the dry consumable. It is contemplated that the base fluid 22 is directed into the mixing chamber 18 from a fluid dispenser 20 positioned near the cartridge 14 and the mixing chamber 18. As discussed above, the fluid dispenser 20 will typically be the sole source of base fluid 22 for disposing the base fluid 22 within the processing chamber 48.

Figure 3A:
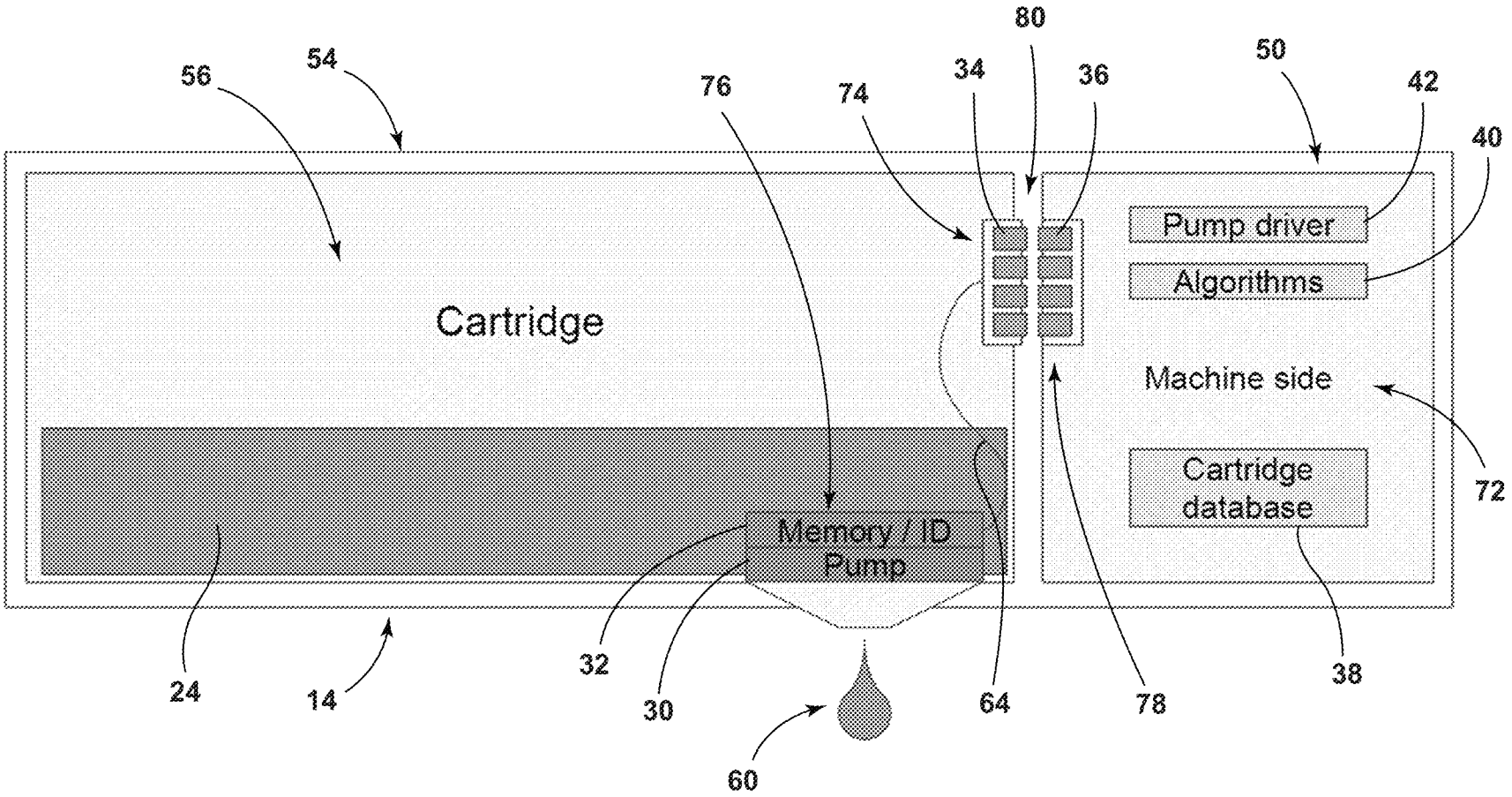
FIG. 3A is a block diagram illustrating an aspect of a cartridge interface of the detergent delivery system.
Figure 3B:
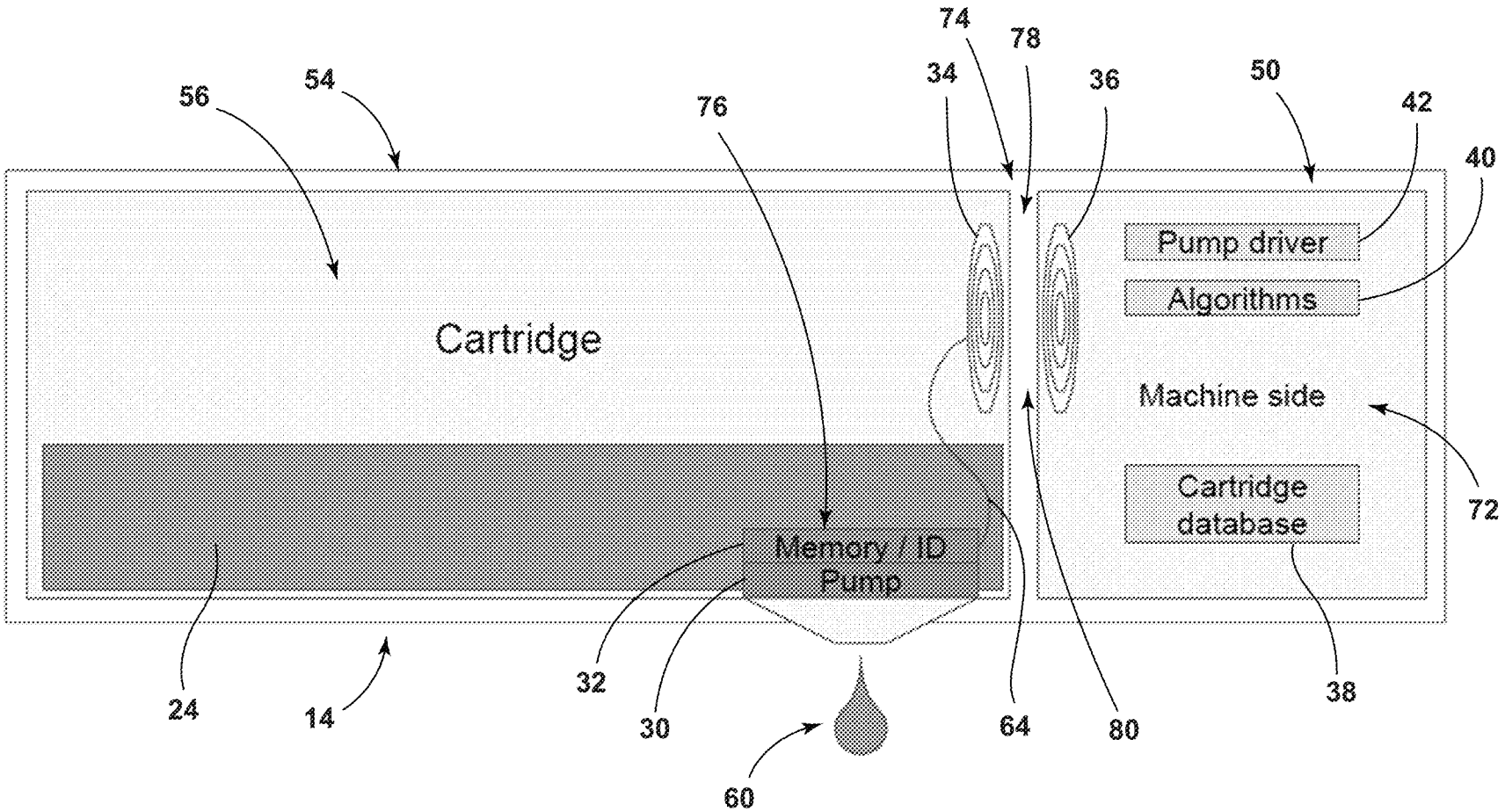
FIG. 3B is a block diagram illustrating an aspect of a cartridge interface of the detergent delivery system.

Referring now to FIGS. 3A and 3B, the cartridge 14 is provided containing a consumable 24. The cartridge 14 also includes the pump 30 configured to dispense the consumable 24 into the mixing chamber 18. In various examples, the pump 30 is self-actuating such that the actuator and the pumping mechanism are contained within the cartridge 14. In certain aspects of the device, the self-actuating pump 30 only requires the actuating electrical current 64 from the appliance 10. It is also contemplated that the cartridge 14 may include an on-board power source, such as a battery. In such an aspect, the pump 30 can receive an activating signal from the appliance 10. In some embodiments, the pump 30 is a microfluidic pump having a constant or variable flow rate. According to some aspects, the pump 30 operates using piezoelectric technology.

The cartridge 14 may further include cartridge circuitry 32 in electrical communication with the laundry appliance 10, typically via the machine circuitry 50. The cartridge 14 includes at least one cartridge connector 34 in communication with at least one machine connector 36 of the machine circuitry 50. The cartridge connector 34 and the machine connector 36 are configured to facilitate the exchange of data and electricity between the cartridge 14 and the machine circuitry 50. In some embodiments, the cartridge connector 34 and the machine connector 36 may be wireless communication devices (e.g. near-field communication ("NFC") devices) as shown in FIG. 3B. Where the connection is a wireless interface 74, the cartridge 14 is typically equipped with a portable power source or wireless power technology in electromagnetic communication with the machine connector 36. This wireless interface 74 can be used to provide a data connection 78 as well as an electrical connection 80 for providing an actuating electrical current 64 to the self-actuating pump 30. As shown in FIG. 3B, in some embodiments, the machine connector 36 includes a wireless power emitter. The data, status information 76 and actuating electrical current 64 exchanged between the machine connector 36 and the cartridge connector 34 is typically via a low-voltage electrical connection 80, such as approximately 70 milliwatts (mW) or some other higher or lower low-voltage current.

The cartridge 14 further includes cartridge circuitry 32 containing data regarding the characteristics of the cartridge 14 and the contents thereof. In some aspects, the data includes a unique identifier such that the controller 72 for the laundry appliance 10 may identify when a specific cartridge 14 is inserted into the laundry appliance 10. The cartridge circuitry 32 may further include a form of electronic memory such that the cartridge 14 can track the amount of consumable 24 remaining in the cartridge 14. Other status information 76 and characteristics of the cartridge 14 that may be stored in the cartridge circuitry 32 can include, but are not limited to, the type of consumable 24, pump circuitry/identifiers, the size of the cartridge 14, the manufacturer of the cartridge 14, the viscosity of the consumable 24, pump flow rate, the number of pump activations, combinations thereof and other similar status information 76. The cartridge circuitry 32 may be configured with read and/or write capabilities such that it may both transmit to and receive data from the laundry appliance 10. Using the stored and rewritten status information 76, the cartridge circuitry 32 can communicate to the controller 72 information related to the status of the cartridge 14. Such status information 76 can include, but is not limited to, replacement information, maintenance information, information related to the quality of the consumable 24, information related to the clogging of consumable 24, failures of the self-actuating pump 30 and other similar status information 76.

Referring again to FIGS. 1-4, the laundry appliance 10 includes a controller 72, typically in the form of machine circuitry 50. The controller 72 and/or the machine circuitry 50 can include a cartridge database 38, programming related to one or more algorithms 40, at least one pump driver 42, and other similar data and components. The cartridge database 38 typically contains information regarding available cartridge types for the laundry appliance 10 and the characteristics of the various cartridge types. Cartridge circuitry 32 typically includes a unique identifier that can be used by the laundry appliance 10 in identifying, determining and evaluating cartridge characteristics (e.g. cartridge size, consumable type, viscosity, pump flow rate, manufacturer, etc.) from the cartridge database 38. According to some aspects, the controller 72 for the laundry appliance 10 includes a server connection 66 (e.g., a wireless electronic connection) to a server 46 and/or a device connection 68 to an electronic user device 44 for updating the cartridge database 38. In some embodiments, characteristics of the cartridge 14 are stored by the cartridge 14 and transmitted to the controller 72 of the laundry appliance 10 without the use of a unique identifier and/or cartridge database 38. It should be understood that the server 46 can be in the form of a local server, offsite server, cloud computing system or other server configuration.

In some embodiments, the machine circuitry 50 includes programming related to one or more algorithms 40 for interfacing with the cartridge 14. For example, in some aspects, multiple cartridges 14 may be coupled to the machine circuitry 50. In such an embodiment, each of the cartridges 14 typically contains a different consumable 24. Based on a selected laundry cycle, and through the use of the one or more algorithms 40, the machine circuitry 50 determines which consumables 24, or combinations thereof, are to be used for the selected laundry cycle. The controller 72, which can be in the form of machine circuitry 50, issues at least one command to the cartridge circuitry 32 of the corresponding cartridge 14 to dispense a certain dosed amount 60 the desired consumable 24. The algorithms 40 can also instruct the other cartridge circuitry 32 of the other cartridges 14 to dispense respective dosed amounts 60 of the various consumables 24. In this manner, the algorithm 40 provides for the dispensed portion 58 of the various consumables 24 to be delivered to the mixing chamber 18.

Figure 4:
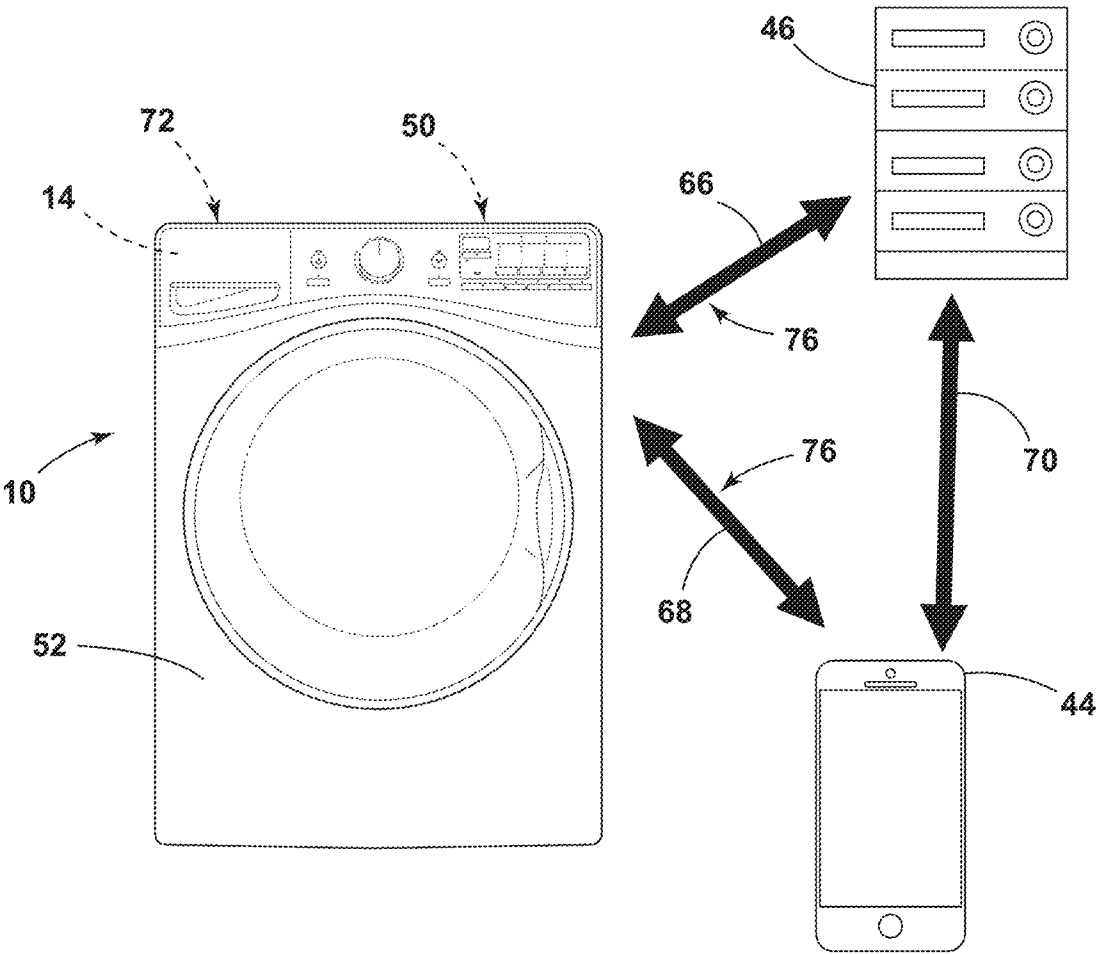
FIG. 4 is a schematic diagram of an electrical communication system of the laundry appliance.
Figure 5:
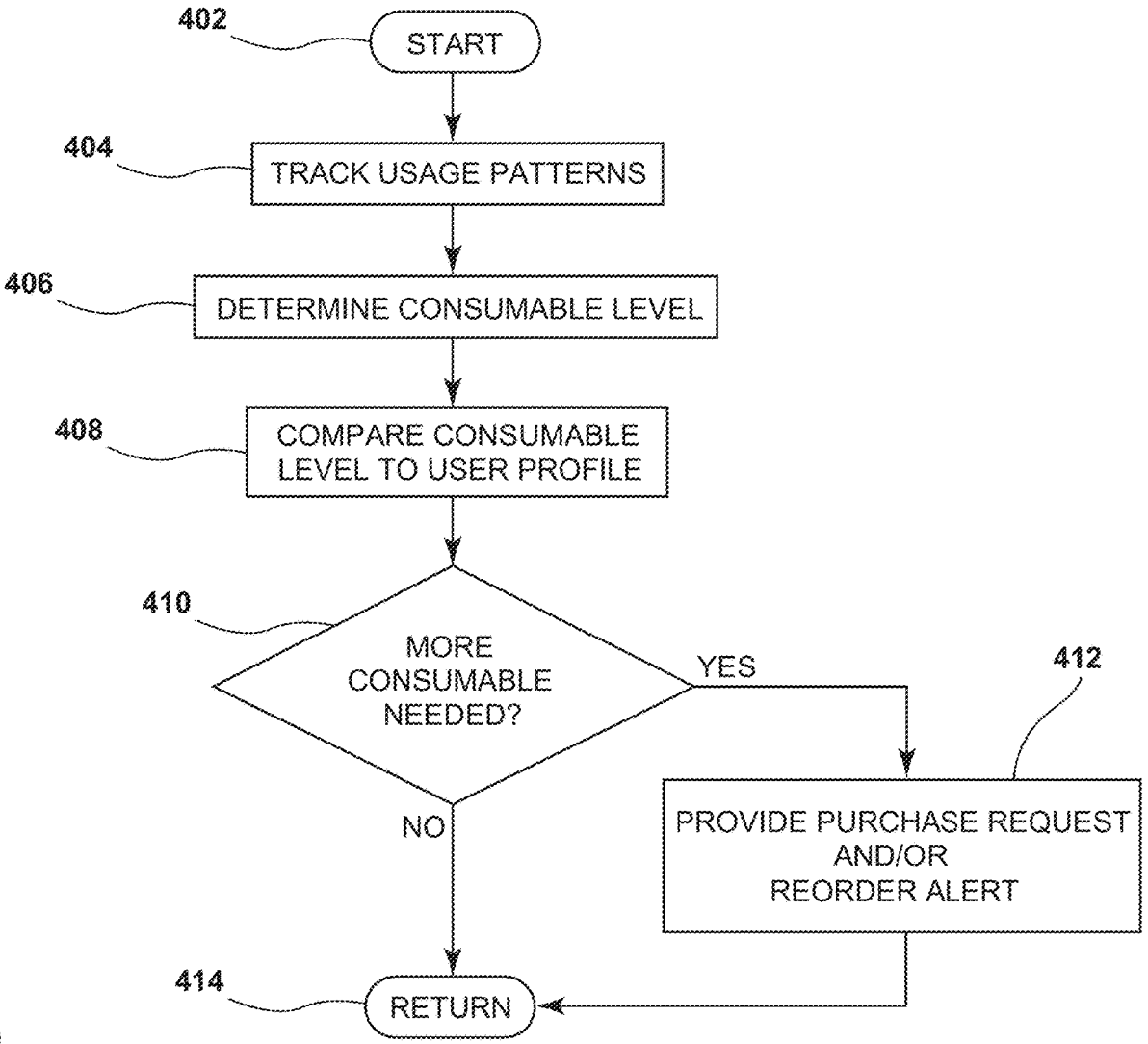
FIG. 5 is a flow diagram for sending a purchase request and/or user alert.

The algorithms 40 may also be configured to generate one or more user profiles, as will be discussed in regard to FIGS. 4 and 5, for determining one or more user characteristics, such as, typical detergent types, and a frequency of use for the laundry appliance 10.

According to some aspects, the algorithms 40 track the amount of consumable 24 dispensed from each unique cartridge 14. Accordingly, the laundry appliance 10, via the controller 72, can determine the amount of remaining consumable 24 in the cartridge 14. This amount of consumable 24 is then compared to a required amount of consumable 24 for the selected cycle about to be performed. In some embodiments, the laundry appliance 10 can provide an alert to the user if the amount of remaining consumable 24 in the cartridge 14 is nearing the required dispended portion of consumable 24 for the selected cycle. Characteristics of the cartridge 14 may also be stored by the controller 72 for the laundry appliance 10 such that the cartridge 14 may be removed from the laundry appliance 10 and reinserted in the laundry appliance 10 without losing data or other status information 76 regarding the characteristics of the cartridge 14 (e.g., amount of remaining consumable 24). In some embodiments, status information 76 and other characteristics of the cartridge 14 are stored by the cartridge circuitry 32 itself upon use.

In some aspects, the laundry appliance 10 includes at least one pump driver 42 for controlling the pump 30 of the cartridge 14. In some examples, the pump driver 42 is used to control the dosed amount 60 of consumable 24 dispensed by the pump 30. The pump driver 42 may also determine a desired flow rate at which the consumable 24 is dispensed for providing and/or adjusting the desired concentration of consumable 24 in the resulting laundry solution 26.

According to some aspects, the cartridge 14 is a non-refillable cartridge where, upon depletion of the consumable 24, the cartridge 14 is discarded. In other embodiments, upon depletion of the consumable 24, the cartridge 14 is sent to a supplier of the consumable 24 to be refilled. The cartridge 14 may then be resold or returned to the user. In such embodiments, the characteristics of cartridge 14 stored in the cartridge circuitry 32 may be overwritten or otherwise updated to indicate the updated conditions of the cartridge 14 (e.g. remaining levels of the consumable 24 and/or a different type of consumable 24 contained in the cartridge 14). Alternatively, or in addition, the cartridge 14 may be configured to be refilled by the user and the characteristics of the cartridge 14 may be updated automatically (e.g., by the opening of a refill port) or manually by the user (e.g., via the laundry appliance 10). In some embodiments, the user may update the characteristics of the cartridge 14 through the use of the electronic user device 44 (FIG. 4) and/or through the use of a feature of the laundry appliance 10.

In some embodiments, based on the characteristics of the cartridge 14, the laundry appliance 10, or the controller 72 therefor, can reject the cartridge 14 if it has one or more non-conforming characteristics. For example, some laundry appliances 10 may only be compatible with specific types of consumable 24. Accordingly, a cartridge 14 containing a non-compatible consumable 24 may be rejected by the laundry appliance 10 and feedback may be given to the user regarding the rejection. In some aspects, the cartridge 14 may be rejected based on other characteristics of the cartridge 14 (e.g., incompatible pump type and/or an unrecognized consumable 24). In some embodiments, the unique identifier of the cartridge 14 is related to information regarding the manufacturer of the cartridge 14 and/or the consumable 24. The laundry appliance 10, using the unique identifier, would validate the cartridge 14 and/or consumable 24 as an original or licensed product. The controller 72, in response to a non-conforming or non-compatible cartridge being inserted in the compartment 12, may provide an alert or warning about a less effective nature of the cartridge 14 and/or the contents thereof.

Referring again to FIG. 4, the machine circuitry 50 may be in electronic communication with at least one of the cartridge 14, the electronic user device 44, and/or the server 46. In some embodiments, as discussed in reference to FIGS. 3A and 3B, the machine circuitry 50 updates one or more databases (e.g., the cartridge database 38 and/or the algorithms 40) via the server connection 66 with the server 46 and/or the device connection 68 with the electronic user device 44. In some aspects, the server connection 66 and/or the device connection 68 are wireless connections. Additionally, it is contemplated that the server connection 66 and/or the device connection 68 may be accomplished through the use of one or more intermediary devices (e.g., a cellular signal, Bluetooth, wireless router and others). In various aspects, the electronic user device 44 and the server 46 are connected through an ancillary connection 70. In various aspects, the server connection 66, the device connection 68, the ancillary connection 70, and combinations thereof comprise any practical form of electronic communication including, but not limited to, cellular connection, Bluetooth, WiFi, a wired connection (e.g., Ethernet), or other similar form of electronic communication. Additionally, communication may be established between the laundry appliance 10, the server 46, and/or the electronic user device 44 in a variety of configurations. In various aspects, information may be relayed between the laundry appliance 10, the server 46, and the electronic user device 44. By way of example, and not limitation, the electronic user device 44 is connected to the laundry appliance 10 through the device connection 68 comprising a Bluetooth connection. Information is then sent to the server 46 from the electronic user device 44 via the ancillary connection 70 comprising a cellular data signal without the need for the server connection 66.

According to some aspects, a user profile is generated from usage patterns of the laundry appliance 10. In various embodiments, the user profile is generated by one of the machine circuitry 50, the electronic user device 44, the server 46, or a combination thereof. Examples of the user information used can include, but are not limited to, types of consumable 24, brands of consumable 24, frequency of usage for the laundry appliance 10, and frequency of specific types of wash cycles. The user profile may be created based on a variety of factors including, but not limited to, geographical location, family size, user activities (e.g., gym activities and/or work activities), skin conditions, user preference for eco-friendly and/or non-chemical consumables, and family composition in terms or age (e.g., families including infants and/or elderly individuals).

In some aspects, the electronic user device 44 includes a plurality of electronic user devices 44. For example, in some embodiments, the user is able to communicate electronically with the laundry appliance 10 via one or more portable electronic devices (e.g., a cellular phone, wearable computing device, a tablet, and/or a laptop), a desktop computer, a digital assistant, and/or an internet of things ("IOT") device. In some embodiments, the electronic user device 44 is configured to communicate with the laundry appliance 10 by a Bluetooth connection, however, any practical forms of electronic communication are contemplated (e.g., WiFi, cellular signal, or via the internet). In some embodiments, the electronic user device 44 does not communicate directly with the laundry appliance 10 but rather via the server 46.

According to some aspects, the electronic user device 44 is configured to both transmit and/or receive information to/from the laundry appliance 10. Information transmitted between the laundry appliance 10 and the electronic user device 44 may include, but is not limited to, low levels of consumable 24 in one or more cartridges 14, installation of an incompatible cartridge 14, and/or requests to purchase additional cartridges 14. In some embodiments, maintenance information (e.g., connection issues between the cartridge 14 and the laundry appliance 10 and/or a malfunction of the cartridge 14) is communicated to at least one of the electronic user device 44 and the server 46.

In some embodiments, the server 46 includes one or more server devices configured to communicate with the laundry appliance 10. In some aspects, content stored on and services run by the server 46 are maintained by the manufacturer of the laundry appliance 10. The server 46 can be used to update software of the user interface controls 16 of the laundry appliance 10, the cartridge database 38, the algorithms 40, or a combination thereof.

In some aspects, the server 46 is associated with a retail merchant. According to some embodiments, the laundry appliance 10 can send a purchase request to the server 46 for a desired cartridge 14. The retail merchant then processes the request and delivers and/or makes available the desired cartridge 14 to the user. In certain aspects, the desired cartridge 14 is automatically determined based on the created user profile. For example, if a specific brand of consumable 24 or a particular type of consumable 24 is frequently used in the laundry appliance 10, the laundry appliance 10 can make the determination that the specific type of consumable 24 is desired and send a purchase request to the retail merchant for the specific consumable 24 when a low level of consumable 24 is detected. In some embodiments, the laundry appliance 10 is configured to suggest to the user (e.g., via the electronic user device 44) recommended cartridges 14 based on a variety of factors including, but not limited to, sale price, time of the year (e.g., for cartridges having a seasonal scent), and cartridges 14 containing new types of consumable 24.

Referring now to FIGS. 1-5, having discussed various aspects of the laundry appliance 10 and the cartridge 14, a method 400 for sending a purchase request and/or reorder alert is provided. In some aspects, the method 400, as shown, is performed by the laundry appliance 10. However, it is contemplated that, in various embodiments, the method 400 is typically performed by at least one of the machine circuitry 50 for the laundry appliance 10, the electronic user device 44, the server 46, or a combination thereof.

According to the method 400, the laundry appliance 10 begins a cycle and the monitoring of the various cartridges 14 begins (step 402). The laundry appliance 10 tracks usage patterns of the user (step 404). This may include, but is not limited to, wash cycle frequencies, types of consumable 24, types and/or sizes of the cartridge 14, and similar information available to the laundry appliance 10. Based on the usage patterns tracked during step 404, the machine circuitry 50 creates and/or updates a user profile. In some aspects, the user profile includes an estimated usage rate of at least one consumable 24. According to the method 400, the machine circuitry 50 determines a remaining level of the consumable 24 for at least one cartridge 14 (step 406). The determined remaining level of the consumable 24 is compared to the estimated usage rate of the at least one consumable 24 to determine an estimated time to empty (step 408). The machine circuitry 50, using the estimated time to empty, determines if more consumable 24 is needed (step 410). If the machine circuitry 50 determines that no consumable 24 is needed, the process returns to the step 402 of the method 400 and continues to monitor the need for additional amounts of the consumable 24 (step 414).

If the machine circuitry 50 makes a determination that more consumable 24 is needed, the machine circuitry 50 provides a purchase request to the server 46 and/or a reorder alert to the electronic user device 44 regarding the need for a desired cartridge 14 containing the needed consumable 24. In some aspects of step 410, the machine circuitry 50 will typically take into account delay factors (e.g., estimated shipping times for the desired cartridge 14) for receiving the desired cartridge 14 and sends the purchase request and/or user alert prior to the consumable 24 being depleted (step 412). After providing the purchase request and/or user alert, the machine circuitry 50 repeats the process and returns to step 402 of the method 400 to monitor the need for additional amounts of the consumable 24 (step 414).

According to another aspect of the present disclosure, a laundry appliance includes a compartment defined within a cabinet. A cartridge is selectively received within the compartment. The cartridge includes a self-actuating pump for dispensing a consumable from an interior of the cartridge. A mixing chamber is positioned under the self-actuating pump. The mixing chamber receives a dispensed portion of the consumable. A fluid dispenser dispenses a base fluid into the mixing chamber. The fluid dispenser is upstream of the self-actuating pump and the base fluid carries the dispensed portion to a processing chamber contained within the cabinet.

According to another aspect, the dispensed portion of the consumable is dispensed from the cartridge in dosed amounts over a predetermined period of time.

According to yet another aspect, the fluid dispenser is a sole source of the base fluid that is delivered to the processing chamber.

According to another aspect of the present disclosure, the compartment includes a plurality of slots. Each slot selectively receives a corresponding cartridge.

According to another aspect, the plurality of slots are positioned over a portion of the mixing chamber.

According to yet another aspect, the base fluid is water.

According to another aspect of the present disclosure, the self-actuating pump is a microfluidic pump that receives an actuating electrical current from a cartridge interface between the cartridge and the compartment.

According to another aspect, the cartridge interface between the cartridge and the compartment is a wireless interface. Data and the actuating electrical current are provided via the cartridge interface.

According to yet another aspect, the predetermined period of time is defined by a fill stage of a laundry cycle.

According to another aspect of the present disclosure, a dispensing assembly for a laundry appliance includes a cartridge having a cartridge connector and that is selectively received within a compartment having a machine connector. A self-actuating pump is contained within the cartridge. The self-actuating pump operates to dispense a consumable from an interior of the cartridge. A mixing chamber is positioned under the self-actuating pump. The mixing chamber receives a dispensed portion of the consumable. A fluid dispenser dispenses a base fluid into the mixing chamber. The fluid dispenser is upstream of the self-actuating pump. A cartridge interface is defined between the cartridge connector and the machine connector. The cartridge interface delivers an actuating electrical current to the self-actuating pump.

According to another aspect, the cartridge includes cartridge circuitry that is in communication with the self-actuating pump and the cartridge connector. The cartridge circuitry delivers status information to the machine connector via the cartridge interface.

According to yet another aspect, the cartridge interface includes a wireless power emitter.

According to another aspect of the present disclosure, the dispensed portion of the consumable is dispensed from the cartridge in dosed amounts over a predetermined period of time.

According to another aspect, the status information includes information related to replacement of the cartridge.

According to yet another aspect, the base fluid is water.

According to another aspect of the present disclosure, the self-actuating pump is a microfluidic pump.

According to another aspect, the cartridge interface between the cartridge and the compartment is a wireless interface. The actuating electrical current and a data connection for delivering the status information are provided via the cartridge interface.

According to yet another aspect, the status information includes maintenance information relating to at least one of detergent quality, detergent clogs, and pump failure.

According to another aspect of the present disclosure, a dispensing assembly for a laundry appliance includes a plurality of cartridges that are selectively received within a compartment having corresponding machine connectors. Each cartridge of the plurality of cartridges includes a self-actuating pump, cartridge circuitry and a cartridge connector in communication with the self-actuating pump and the cartridge circuitry. Each cartridge of the plurality of cartridges contains a respective consumable. A mixing chamber is positioned under the plurality of cartridges. The mixing chamber receives a dispensed portion of each respective consumable from the plurality of cartridges. A fluid dispenser dispenses a base fluid into the mixing chamber. The fluid dispenser is upstream of the self-actuating pumps of the plurality of cartridges. A cartridge interface is defined between each cartridge connector of the plurality of cartridges and corresponding machine connectors of the compartment. The cartridge interface delivers an actuating electrical current to each of the self-actuating pumps.

According to another aspect, the self-actuating pumps of the plurality of cartridges are microfluidic pumps that deliver the respective consumable into the mixing chamber as an extended dosing that occurs over a predetermined period of time.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a compartment defined within a cabinet;

a removable cartridge selectively received within the compartment, wherein the removable cartridge includes a self-actuating pump within a reservoir of the removable cartridge for dispensing a consumable from the reservoir of the removable cartridge;

a mixing chamber positioned under the self-actuating pump, wherein the mixing chamber receives a dispensed portion of the consumable; and a fluid dispenser that dispenses a base fluid into the mixing chamber, wherein the fluid dispenser is upstream of the self-actuating pump and wherein the base fluid carries the dispensed portion to a processing chamber contained within the cabinet, wherein the self-actuating pump includes an electrically-powered actuator and a pump mechanism that is operated by the electrically-powered actuator, and wherein the electrically-powered actuator and the pump mechanism are disposed within the reservoir of the removable cartridge.

2. The laundry appliance of claim 1, wherein the dispensed portion of the consumable is dispensed from the removable cartridge in dosed amounts over a predetermined period of time.

3. The laundry appliance of claim 2, wherein the predetermined period of time is defined by a fill stage of a laundry cycle.

4. The laundry appliance of claim 1, wherein the fluid dispenser is a sole source of the base fluid that is delivered to the processing chamber.

5. The laundry appliance of claim 1, wherein the compartment includes a plurality of slots, wherein each slot selectively receives a corresponding removable cartridge.

6. The laundry appliance of claim 5, wherein the plurality of slots are positioned over a portion of the mixing chamber.

7. The laundry appliance of claim 1, wherein the base fluid is water.

8. The laundry appliance of claim 1, wherein the self-actuating pump is a microfluidic pump that receives an actuating electrical current from a cartridge interface that is defined between the removable cartridge and the compartment, wherein the actuating electrical current is delivered to the electrically-powered actuator.

9. The laundry appliance of claim 8, wherein the cartridge interface between the removable cartridge and the compartment is a wireless interface, wherein data and the actuating electrical current are provided via the cartridge interface.

10. A dispensing assembly for a laundry appliance comprising:

a removable cartridge having a cartridge connector and selectively received within a compartment having a machine connector;

a self-actuating pump contained within an interior of the removable cartridge, wherein the self-actuating pump operates to dispense a consumable from the interior of the removable cartridge, the self-actuating pump having an electrically-powered actuator and a pump mechanism that is operated by the electrically-powered actuator, and wherein the electrically-powered actuator and the pump mechanism are disposed within the removable cartridge;

a mixing chamber positioned under the self-actuating pump, wherein the mixing chamber receives a dispensed portion of the consumable;

a fluid dispenser that dispenses a base fluid into the mixing chamber, wherein the fluid dispenser is upstream of the self-actuating pump; and a cartridge interface defined between the cartridge connector and the machine connector, wherein the cartridge interface delivers an actuating electrical current to the electrically-powered actuator of the self-actuating pump.

11. The dispensing assembly of claim 10, wherein the removable cartridge includes cartridge circuitry that is in communication with the self-actuating pump and the cartridge connector, wherein the cartridge circuitry delivers status information to the machine connector via the cartridge interface.

12. The dispensing assembly of claim 11, wherein the status information includes information related to replacement of the removable cartridge.

13. The dispensing assembly of claim 11, wherein the self-actuating pump is a microfluidic pump that is contained within a reservoir of the removable cartridge.

14. The dispensing assembly of claim 11, wherein the cartridge interface between the removable cartridge and the compartment is a wireless interface, wherein the actuating electrical current and a data connection for delivering the status information are provided via the cartridge interface.

15. The dispensing assembly of claim 11, wherein the status information includes maintenance information relating to at least one of detergent quality, detergent clogs, and pump failure.

16. The dispensing assembly of claim 10, wherein the cartridge interface includes a wireless power emitter.

17. The dispensing assembly of claim 10, wherein the dispensed portion of the consumable is dispensed by the self-actuating pump from the removable cartridge in dosed amounts over a predetermined period of time.

18. The dispensing assembly of claim 10, wherein the base fluid is water.

19. A dispensing assembly for a laundry appliance comprising:

a plurality of removable cartridges that are selectively received within a compartment having corresponding machine connectors, wherein each removable cartridge of the plurality of removable cartridges includes a self-actuating pump having an electrically-powered actuator and a pump mechanism contained within an interior thereof, cartridge circuitry and a cartridge connector in communication with the electrically-powered actuator of the self-actuating pump and the cartridge circuitry of each removable cartridge, wherein each removable cartridge of the plurality of removable cartridges contains a respective consumable;

a mixing chamber positioned under the plurality of removable cartridges, wherein the mixing chamber receives a dispensed portion of each respective consumable from the plurality of removable cartridges;

a fluid dispenser that dispenses a base fluid into the mixing chamber, wherein the fluid dispenser is upstream of each self-actuating pump of the plurality of removable cartridges; and a cartridge interface defined between each cartridge connector of the plurality of removable cartridges and the corresponding machine connectors of the compartment, wherein the cartridge interface delivers an actuating electrical current to each electrically-powered actuator.

20. The dispensing assembly of claim 19, wherein each self-actuating pump of the plurality of removable cartridges is a microfluidic pump that delivers the respective consumable into the mixing chamber as an extended dosing that occurs over a predetermined period of time.

* * * * *